US006766870B2

(12) United States Patent
Overstreet

(10) Patent No.: US 6,766,870 B2
(45) Date of Patent: Jul. 27, 2004

(54) MECHANICALLY SHAPED HARDFACING CUTTING/WEAR STRUCTURES

(75) Inventor: James L. Overstreet, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 34 days.

(21) Appl. No.: 10/225,710

(22) Filed: Aug. 21, 2002

(65) Prior Publication Data

US 2004/0035609 A1 Feb. 26, 2004

(51) Int. Cl.[7] ..... E21B 10/16

(52) U.S. Cl. ..... 175/374; 175/378; 175/425; 175/428

(58) Field of Search ..... 175/374, 425, 175/426, 428, 378; 76/108.2, 108.4

(56) References Cited

U.S. PATENT DOCUMENTS

| | | | | | |
|---|---|---|---|---|---|
| 2,407,642 | A | | 9/1946 | Ashworth | |
| RE25,684 | E | * | 11/1964 | Coulter | 76/108.1 |
| 3,401,759 | A | * | 9/1968 | White | 175/341 |
| 3,800,891 | A | | 4/1974 | White et al. | |
| 4,006,788 | A | | 2/1977 | Garner | |
| 4,012,238 | A | * | 3/1977 | Scales | 148/217 |
| 4,445,580 | A | * | 5/1984 | Sahley | 175/404 |
| 4,455,278 | A | | 6/1984 | van Nederveen et al. | |
| 4,533,812 | A | | 8/1985 | Lorenz | |
| 4,884,477 | A | | 12/1989 | Smith et al. | |
| 5,051,112 | A | | 9/1991 | Keshavan et al. | |
| 5,131,480 | A | * | 7/1992 | Lockstedt et al. | 175/374 |
| 5,150,636 | A | * | 9/1992 | Hill | 76/108.2 |
| 5,159,857 | A | | 11/1992 | Jurewicz | |
| 5,247,923 | A | | 9/1993 | Lebourg | |
| 5,291,807 | A | | 3/1994 | Vanderford et al. | |
| 5,311,958 | A | * | 5/1994 | Isbell et al. | 175/341 |
| 5,351,768 | A | * | 10/1994 | Scott et al. | 175/374 |
| 5,492,186 | A | | 2/1996 | Overstreet et al. | |
| 5,516,053 | A | | 5/1996 | Hannu | |
| 5,582,258 | A | | 12/1996 | Tibbitts et al. | |
| 5,592,995 | A | * | 1/1997 | Scott et al. | 175/374 |
| 5,663,512 | A | | 9/1997 | Schader et al. | |
| 5,695,018 | A | * | 12/1997 | Pessier et al. | 175/331 |
| 5,758,733 | A | | 6/1998 | Scott et al. | |
| 5,791,423 | A | | 8/1998 | Overstreet et al. | |
| 5,819,861 | A | * | 10/1998 | Scott et al. | 175/371 |
| 5,833,020 | A | * | 11/1998 | Portwood et al. | 175/331 |
| 5,855,247 | A | * | 1/1999 | Scott et al. | 175/374 |
| 5,868,213 | A | * | 2/1999 | Cisneros et al. | 175/331 |
| 5,921,330 | A | | 7/1999 | Sue et al. | |
| 5,967,245 | A | * | 10/1999 | Garcia et al. | 175/374 |
| 5,967,250 | A | * | 10/1999 | Lund et al. | 175/428 |
| 5,979,575 | A | | 11/1999 | Overstreet et al. | |
| 6,045,750 | A | | 4/2000 | Drake et al. | |
| 6,206,115 | B1 | | 3/2001 | Overstreet et al. | |
| 6,206,116 | B1 | * | 3/2001 | Saxman | 175/378 |
| RE37,127 | E | | 4/2001 | Schader et al. | |
| 6,234,261 | B1 | | 5/2001 | Evans et al. | |
| 6,371,225 | B1 | * | 4/2002 | Overstreet et al. | 175/374 |
| 6,443,246 | B1 | * | 9/2002 | Pessier et al. | 175/378 |
| 6,640,913 | B2 | * | 11/2003 | Lockstedt et al. | 175/331 |
| 2002/0017402 | A1 | | 2/2002 | Bird | |

FOREIGN PATENT DOCUMENTS

| | | |
|---|---|---|
| EP | 0 569 663 A1 | 5/1993 |

* cited by examiner

*Primary Examiner*—David Bagnell
*Assistant Examiner*—Shane Bomar
(74) *Attorney, Agent, or Firm*—Bracewell & Patterson, L.L.P.

(57) ABSTRACT

A hardfacing material is applied to cutting elements formed on the surface of cutters of an earth-boring bit. The hardfacing material forms the outer surface of the teeth, and also substantially forms scrapers on the shell of each of the cutters. The adding of the hardfacing material to the outer surface of the teeth and the forming of the scrapers is accomplished through welding. The hardfacing material is machined from its "as-welded" state to have a smoother surface finish.

18 Claims, 3 Drawing Sheets

MECHANICALLY SHAPED HARDFACING CUTTING/WEAR STRUCTURES

BACKGROUND OF THE INVENTION

1. Field of the Invention

This invention relates generally to earth-boring drill bits and particularly to improved cutting structures for such bits.

2. Background of the Art

In drilling bore holes in earthen formations by the rotary method, rock bits fitted with one, two, or three rolling cutters are employed. The bit is secured to the lower end of a drillstring that is rotated from the surface, or the bit is rotated by downhole motors or turbines. The cutters or cones mounted on the bit roll and slide upon the bottom of the bore hole as the bit is rotated, thereby engaging and disengaging the formation material to be removed. The rolling cutters are provided with cutting elements that are forced to penetrate and gouge the bottom of the borehole by weight of the drillstring. The cuttings from the bottom sidewalls of the borehole are washed away by drilling fluid that is pumped down from the surface through the hollow drillstring.

One type of cutting element in widespread use is a tungsten carbide insert which is interference pressed into an aperture in the cutter body. Tungsten carbide is metal which is harder than the steel body of the cutter and has a cylindrical portion and a cutting tip portion. The cutting tip portion is formed in various configurations, such as chisel, hemispherical or conical, depending on the type of formation to be drilled. Some of the inserts have very aggressive cutting structure designs and carbide grades that allow the bits to drill in both soft and medium formations with the same bit.

Another type of rolling cutter earth-boring bit is commonly known as a "steel tooth" or "milled tooth" bit. Typically these bits are for penetration into relatively soft geological formations of the earth. The strength and fracture toughness of the steel teeth permits the use of relatively long teeth, which enables the aggressive gouging and scraping actions that are advantageous for rapid penetration of soft formations with low compressive strengths.

However, it is rare that geological formations consist entirely of soft material with low compressive strength. Often, there are streaks of hard, abrasive materials that a steel-tooth bit should penetrate economically without damage to the bit. Although steel teeth possess good strength, abrasion resistance is inadequate to permit continued rapid penetration of hard or abrasive streaks. Consequently, it has been common in the arts since at least the 1930s to provide a layer of wear-resistance metallurgical material called "hardfacing" over those portions of the teeth exposed to the severest wear. The hardfacing typically consists of extremely hard particles, such as sintered, cast, or macrocrystalline tungsten carbide, dispersed in a steel matrix. Such hardfacing materials are applied by welding a metallic matrix to the surface to be hardfaced and applying the hard particles to the matrix to form a uniform dispersion of hard particle in the matrix.

Typical hardfacing deposits are welded over a steel tooth that has been machined similar to the desired final shape. The hardfacing materials do not have a tendency to heat crack, which helps counteract the occurrence of frictional heat cracks associated with carbide inserts. The hardfacing is much harder than the steel tooth inserts, therefore the hardfacing on the surface of steel teeth makes the teeth more resistant to wear.

Developments in hardfacing materials and welding skill have improved the overall quality of the hardfacing deposits, which allows for thicker deposits to be welded onto the teeth, which are usually smaller to accommodate the addition of hardfacing materials. However, the geometry of the tooth profile can vary considerably depending on the skill of the welder, the geometry of the tooth that the hardfacing is being applied to, and the desired geometry of the desired tooth after the hardfacing is applied. These variables have produced cutting elements which were not uniform throughout their respective rows, and which were only capable of having the final shape after hardfacing. In the "as-welded" state, the cutting efficiency of the bit was not optimal because the cutting elements were not uniform within their respective cutting rows. Furthermore, cutting efficiency was not optimal because the smoothness of the hardfacing varied depending on welder skill.

In the prior art, hardfacing on the gauge surface of the cone is ground smooth so that the bit remains the desired diameter. However, the hardfacing on the leading and trailing flanks of the teeth is not ground.

BRIEF SUMMARY OF THE INVENTION

An earth-boring bit has a bit body and at least one cantilevered bearing shaft depending inwardly and downwardly from the bit body. A cutter is mounted for rotation on each bearing shaft wherein each cutter includes a plurality of cutting elements. The cutting elements are arranged in circumferential rows on the cutter and at least some of the cutter elements comprise teeth. At least some of the teeth have a hardfacing composition of carbide particles dispersed in a metallic matrix, which has at least one smooth ground flank.

The purpose of this invention is to allow for the mechanical shaping of the welded tooth deposits into more useable cutting/wear elements. This would allow for the shaping of several different geometries from typical hardfacing deposits. This also allows for differences in geometry of teeth on the same row or on different rows or in between the rows, or anywhere on the immediate cone shell. Shaped hardfacing cutting/wear elements can be used on a variety of cutting materials including steel teeth, tungsten carbide teeth bits, diamond bits, or other downhole tools. The shaping of the cutting/wear element could be accomplished by grinding, plunge electrical-discharge machining (EDM), wire EDM, laser machining, or by any other method capable of shaping hardfacing after it is applied.

DETAILED DESCRIPTION OF THE PREFERRED EMBODIMENT

Figure 1:
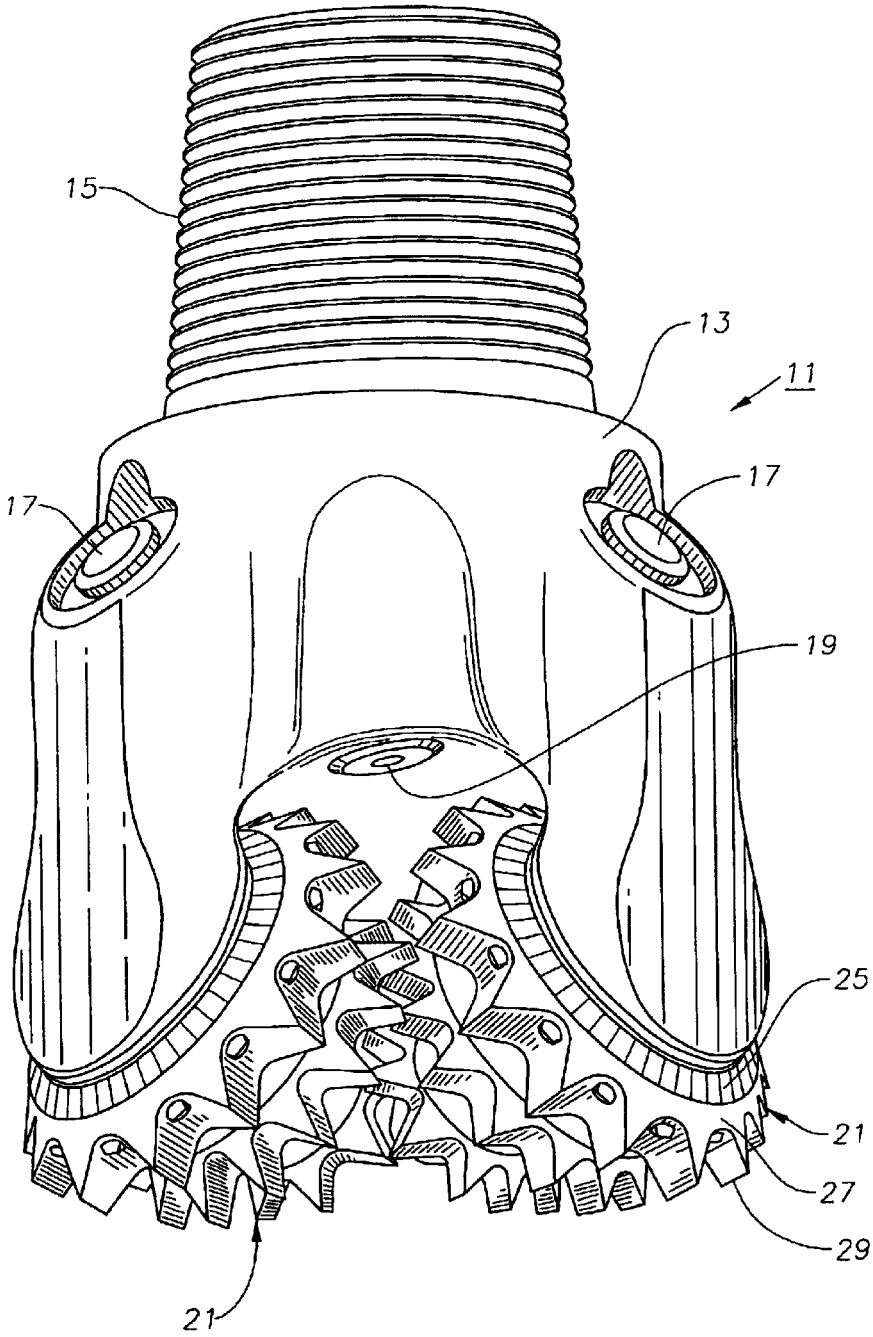
FIG. 1 is a perspective view of an earth-boring bit of the steel tooth type constructed in accordance with this invention.

Referring to FIG. 1, an earth-boring bit 11 according to the present invention is illustrated. Bit 11 includes a bit body 13 having threads 15 at its upper extent for connecting bit 11 into a drill string (not shown). Each leg of bit 11 is provided with a lubricant compensator 17. And at least one nozzle 19 is provided in bit body 13 for directing pressurized drilling fluid from within the drill string to cool and lubricate bit 11 during drilling operation. A plurality of cutters 21 are rotatably secured to respective legs of bit body. Typically, each bit 11 has three cutters 21, and one of the three cutters is obscured from view in FIG. 1.

Figure 2:
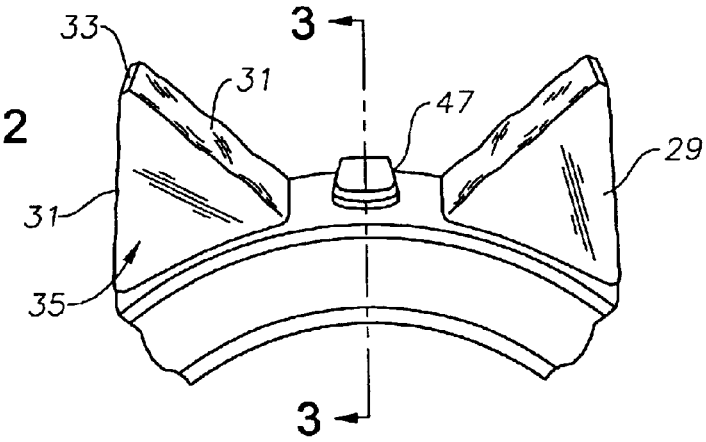
FIG. 2 is an enlarged perspective view of a set of cutting elements of the earth-boring bit shown in FIG. 1 constructed in accordance with this invention.
Figure 4:
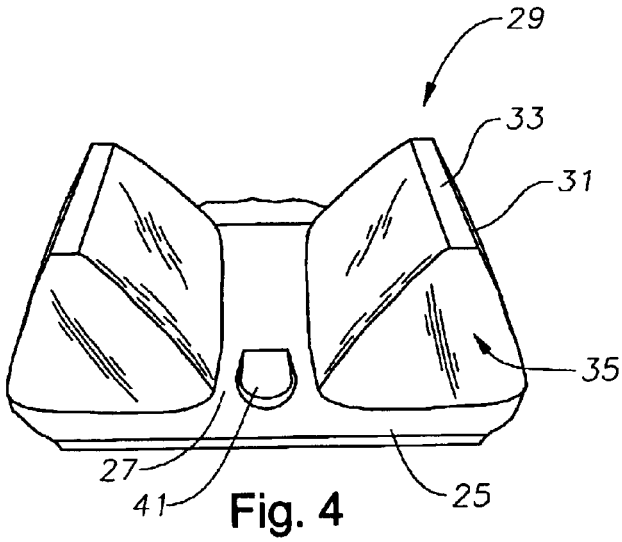
FIG. 4 is a perspective view of the set of cutter elements shown in FIG. 2.

Each cutter 21 has a shell surface including a gauge surface 25 and a heel region indicated generally at 27. Teeth 29 are formed in heel region 27 and form a heel row 29 of teeth. As shown in FIGS. 2 and 4, heel teeth 29 are of generally conventional design, each having leading and trailing flanks 31 which converge to a crest 33. Each tooth 29 has an inner end (not shown) and an outer end 35 that join to crest 33. Crests 33 are perpendicular to the direction of rotation of cutter 21. As best shown in FIG. 1, gauge surface 25 extends generally to and borders outer ends 35 of teeth 29.

Figure 6:
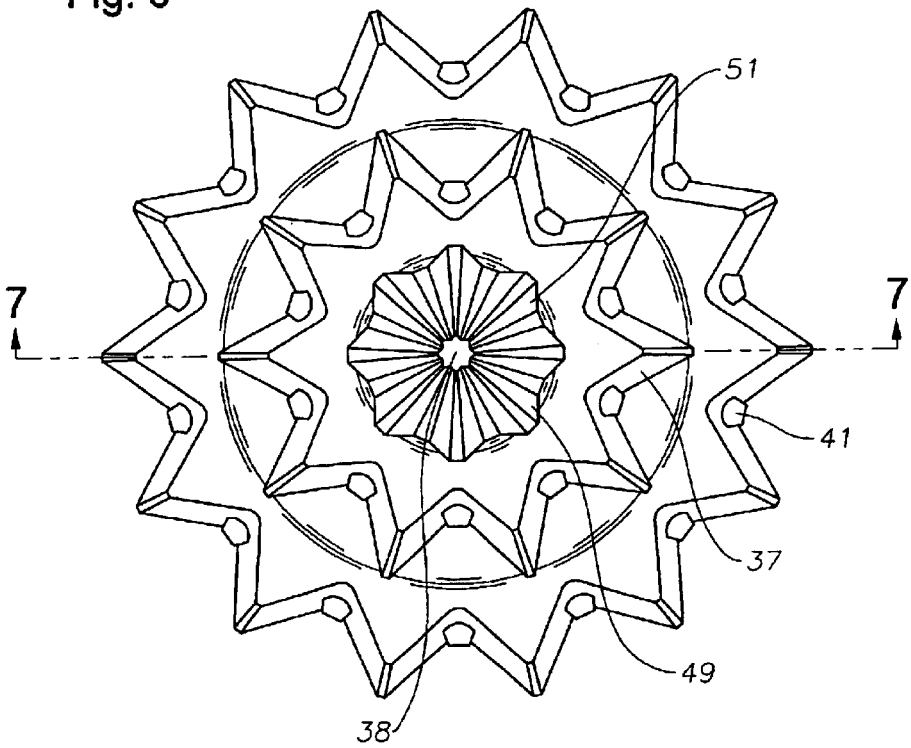
FIG. 6 is plan elevational view of a cutter of the earth-boring bit shown in FIG. 1 and constructed in accordance with this invention.
Figure 7:
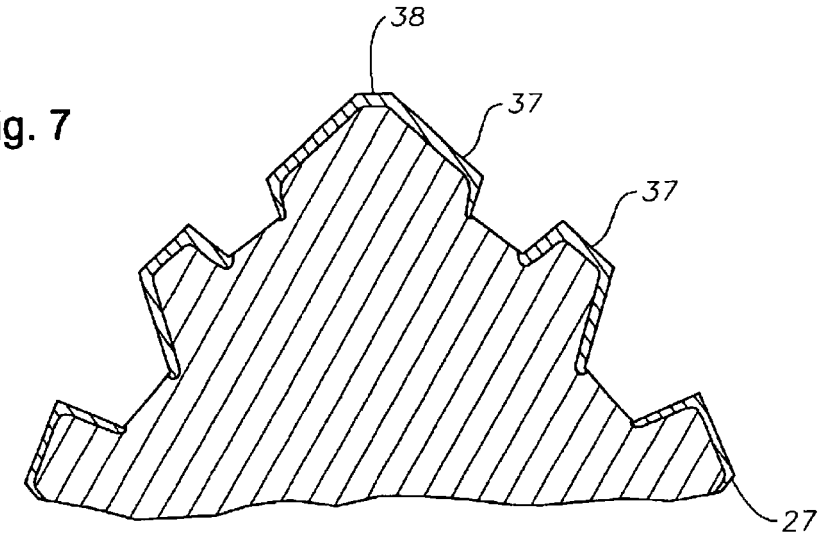
FIG. 7 is a cross sectional view, taken along the line 7—7 of FIG. 6, of the cutter constructed in accordance with this invention.

Referring to FIGS. 6 and 7, inner row teeth 37 are formed on each cutter 21 radially inward from heel 27 up to the apex 38 of cutter 21. One of cutters 21 typically has a spear point (not shown) on its apex 38, another an inner row of teeth 37 (not shown) near its apex 38, and the third has a conical apex 38 free of teeth, this cutter 21 being shown in FIG. 6. Each cutter 21 will have one or more rows of inner row teeth 37, and one or more of cutters 21 may have inner row teeth 37 at apex 38 of cutter 21. Inner row teeth 37 also have crests and flanks oriented similar to heel row teeth 29.

Figure 5:
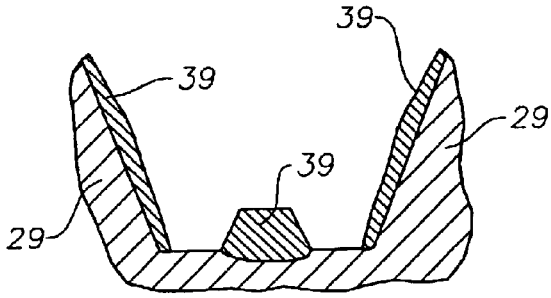
FIG. 5 is a cross sectional view of the set of cutter elements shown in FIG. 2.

Referring to FIG. 5, hardfacing 39 is formed on each of the heel row teeth 29. Hardfacing 39 preferably covers the entire tooth 29, including flanks 31, crest 33, and outer end 35. Hardfacing 39 is a metallic matrix having carbide particles therein, and may be placed on the teeth 29 using methods known in the art. Typically, hardfacing 39 is also formed on each of inner row teeth 37 as well. Hardfacing formed on heel row teeth 29 may help wear resistance of teeth 29 because of the hardness characteristics of the material in hardfacing 39. Teeth 29 are in their "as-welded" form once the hardfacing 39 is welded onto teeth 29.

Figure 3:
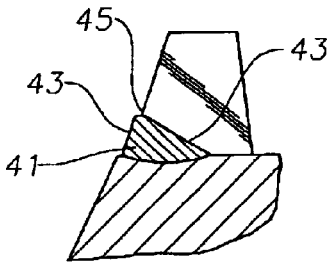
FIG. 3 is a cross sectional view, taken along the line 3—3 of FIG. 2, of the cutter elements constructed in accordance with this invention.

Referring to FIGS. 2–5, a scraper or trimmer tooth 41 is formed at a position between two heel row teeth 29. Scrapers 41 are formed generally at the intersection of gauge surface 25 and heel surface 27 for engaging the sidewall of a borehole. As illustrated in FIG. 3, scrapers 41 also have flanks 43 that converge to a crest 45 like teeth 29. However, scraper crests 45 are perpendicular to heel row teeth crests 33 and parallel to the direction of rotation of cutters 21. Scrapers 41 have flat side surfaces 47. The outer flank is substantially parallel with the cutter gauge surface. The inner flank 43 inclines at a greater angle than the outer flank. Each scraper 41 is formed entirely of hardfacing 39 and is formed by the same technique as is commonly employed when applying hardfacing 39 to teeth 29. Hardfacing 39 is built up into generally outward protuberances that take the "as-welded" form of scrapers 41.

In addition, a hardfacing deposit 49 may optionally be formed on other portions of the body of cutter 21, such as around apex 38 of the third cutter 21, as shown in FIG. 6. Deposit 49 is thinner than conventional teeth 37 to avoid interference with the spear point (not shown) and innermost row of teeth 37 on the other cones. Deposit 49 is a generally conical hardfaced surface formed around apex 38.

Teeth 29, inner row teeth 37, scrapers 41, and deposit 49 are machined from their "as-welded" state to shape cutting elements 29, 37, 41, and deposit 49 to a desired final shape. Machining also allows manufacturers to make the surfaces of cutting elements 29, 37, and 41 smoother than they are in their "as-welded" state. In the final shape, inner and outer ends 35, flanks 31 and crests 33 will be machined into fairly straight flat surfaces as shown in FIGS. 3–5. Scraper inserts 41 will have flat inner and outer flanks 43, crest 45 and side surfaces 47, as shown in FIGS. 2–5. Deposit 49 is machined with radial grooves 51 to form elongated tooth-like protuberances or cutting elements that assist in cutting.

Welders are capable of applying thicker amounts of hardfacing 39 with the advancements in the application of hardfacing 39. In the preferred embodiment, the manufacturer applies hardfacing 39 so that the size of cutting elements 29, 37, 41, and deposit 49 are larger than desired. The "as-welded" cutting elements 29, 37, 41, and deposit 49 are then machined using processes known in the art to shape cutting elements 29, 37, 41, and deposit 49. Machining cutting elements 29, 37, 41, and deposit 49 allows the manufacturer to have more uniformly shaped cutting elements, as well as allows the manufacturer to design more aggressive cutting elements due to specific geometries of cutting elements 29, 37, 41, and deposit 49.

Preferably, machining cutting elements is performed with 4, 5, and/or 6-axis milling/machining. With five and six-axis machining, particularly, a large variety of shapes can be produced, which allows manufacturers to design more aggressive cutting geometries for cutting elements 29, 37 and 41. Typically, cutting elements 29, 37, 41, and deposit 49 will have distinct changes in surface elevations or abrupt bead edges from the beading of welding material, and may have a surface roughness of more than 200 micro inches after shaping, or recesses where each bead of weld material is added. Machining which only shapes cutting elements 29, 37, 41 and deposit 49 but does not provide a smooth finish may increase the efficiency of bit 11 as desired. However, with abrupt bead edges or with a surface roughness of more than 200 micro inches, deposits may form on the surface of cutting elements 29, 37, 41, and deposit 49.

The five and six-axis machining may occur after hardfacing 39 is applied to a substrate, as is the case for teeth 29, 37, scrapers 41 and deposit 49. Furthermore, manufactures may also use the five and six-axis machining on the substrates of cutting elements 29 and 37 before applying hardfacing 39. Machining the substrates of cutting elements 29 and 37 allows the welder to apply hardfacing 39 more closely resembling the final geometry of cutting elements 29 and 37. Further, hardfacing 39 can be more uniform across the entire surface of cutting elements 29 and 37 because hardfacing 39 can be applied to a substrate more closely resembling the final geometry of cutting elements 29 and 37.

A surface finish between the range of 0.1 and 100 micro inches is desirable in order for cutting elements 29, 37, 41, and deposit 49 to reduce the accumulation of particles and increase cutting efficiency in some soils. Typically, the surface finish will be machined to a range between 40 and 50 micro inches, with further machining as desired. Achieving the surface finish between the above ranges can typically be accomplished through grinding, polishing, electrical-discharge machining (EDM), wire EDM, laser machining, or any combination thereof. Other methods that achieve a surface finish within the ranges above also known in the art and may be substituted.

Though shaping and machining has been described above for hardfacing 39 on steel teeth, as well as structures made entirely of hardfacing 39, machined hardfacing 39 could be used on other tools like diamond bits, or on other downhole tools.

Teeth 29, inner row teeth 37, and scrapers 41, each have better qualities with hardfacing 39. Machining cutting elements after welding on hardfacing allows manufactures to create more uniform and/or more aggressive cutting elements, which may increase the overall cutting efficiency of the bit. Therefore the machined cutting elements described above allow the bit to dill longer, farther, and faster than previous earth-boring bits. The central deposit on the third cutter or cone increases wear resistance as well as enhances cutting.

While the invention has been shown in only one of its forms, it should be apparent to those skilled in the art that it is not so limited, but is susceptible to various changes without departing from the scope of the invention. For example, rather than using the types of machining listed in the description, a manufacturer could also achieve the desired smoothness through any other type of machining capable of shaping hardfacing materials. Also, hardfacing deposits could be applied and machined between the inner rows on the cutter shell if erosion is a problem.

I claim:

1. An earth-boring bit comprising:

a bit body;

at least one cantilevered bearing shaft depending inwardly and downwardly from the bit body;

a cutter mounted for rotation on the bearing shaft, and a plurality of cutting elements on the cutter, including a heel row of cutting elements having a gage surface, at least one of the cutting elements having a hardfacing other than or in addition to a hardfacing on its gage surface that is a composition of carbide particles dispersed in a metallic matrix with a smooth machined surface.

2. The bit of claim 1, wherein said at least one of the cutting elements has a pair of flanks that converge to a crest, and the smooth machined surface is located on at least one of the flanks.

3. The bit of claim 1, wherein said at least one of the cutting elements has an inner end and an outer end, and the smooth machined surface is located on a portion of at least one of the ends.

4. The bit of claim 1, wherein the cutting elements included in the heel row comprise a set of teeth; and wherein said at least one of the cutting elements comprises a scraper located in a valley between each of the teeth, each of the scrapers being substantially smaller than the teeth; and wherein the smooth machined surface is located on an inner end of each of the scrapers.

5. The bit of claim 4, wherein each of the scrapers has a crest; and wherein the smooth machined surface is also located on the crest.

6. The bit of claim 4, wherein each of the scrapers has an outer end, the inner and outer ends being flanks that terminate in a crest; and wherein the smooth machined surface is located on the flanks and the crest of each of the scrapers.

7. The bit of claim 1, wherein said at least one of the cutting elements is located closer to an apex of the cutter than the gage surface.

8. The bit of claim 1, wherein said at least one of the cutting elements is located at an apex of the cutter; and wherein the smooth machined surface has a plurality of radially extending grooves machined therein.

9. The bit of claim 1, wherein the smooth machined surface has a surface finish smoother than 200 micro inches.

10. The bit of claim 1, wherein the smooth machined surface has a surface finish less than 100 micro inches.

11. The bit of claim 1, wherein the smooth machined surface has a surface finish in the range of 40 to 50 micro inches.

12. An earth-boring bit comprising:

at least one rotatable cutter having a plurality of steel cuffing elements arranged in circumferential inner rows and a heel row;

the cutting elements in the heel row having a layer of a hardfacing composition of carbide particles dispersed in a metallic matrix, the hardfacing composition having a smooth machined surface on a gage surface of the heel row and in addition a smooth machined surface other than on the gage surface.

13. The bit of claim 12, wherein the cutting elements in the heel row comprise a plurality of scrapers and a plurality of teeth, each of the scrapers being formed essentially of the hardfacing composition, each of the scrapers being located in a valley between two of the teeth, each of the scrapers having a pair of flanks that converge to a crest; and wherein the smooth machined surface is located on the flanks and crest of the scrapers.

14. The bit of claim 13, wherein the smooth machined surfaces have surface finishes that are less than 200 micro inches.

15. The bit of claim 12, further comprising a deposit of hardfacing having a smooth machined surface on the cutter closer to an apex of the cutter than the heel row of cutting elements.

16. The bit of claim 12, further comprising a deposit of hardfacing on an apex of the cutter, the deposit of hardfacing being smooth machined with a plurality of radially extending grooves to define a cutting element.

17. An earth-boring bit comprising:

a plurality of rotatable cutters, each of the cutters having a plurality of steel cuffing teeth arranged in circumferential inner rows and a heel row;

a plurality of scrapers, each of the scrapers being located in a valley between two of the teeth of the heel row, each of the scrapers having a pair of flanks leading to a crest that is perpendicular to a radial line emanating from an apex of each of the cutters; and each of the scrapers being formed entirely of a hardfacing composition having carbide particles dispersed in a metallic matrix, the flanks and crest of the each of the scrapers having smooth machined surfaces.

18. The bit according to claim 17 wherein the smooth machined surfaces have surface finishes less than 200 micro inches.

* * * * *